US008881981B2

(12) United States Patent
Millett

(10) Patent No.: US 8,881,981 B2
(45) Date of Patent: Nov. 11, 2014

(54) DIGITAL TARGETING SCOPE APPARATUS

(71) Applicant: James A. Millett, Huntington Beach, CA (US)

(72) Inventor: James A. Millett, Huntington Beach, CA (US)

( * ) Notice: Subject to any disclaimer, the term of this patent is extended or adjusted under 35 U.S.C. 154(b) by 133 days.

(21) Appl. No.: 13/786,383

(22) Filed: Mar. 5, 2013

(65) Prior Publication Data

US 2014/0124575 A1 May 8, 2014

Related U.S. Application Data

(63) Continuation-in-part of application No. 13/412,506, filed on Mar. 5, 2012, now Pat. No. 8,807,430.

(51) Int. Cl.

| | |
|---|---|
| ***G06G 7/80*** | (2006.01) |
| ***F41G 1/38*** | (2006.01) |
| ***F41G 1/473*** | (2006.01) |

(52) U.S. Cl.

CPC . *F41G 1/38* (2013.01); *F41G 1/473* (2013.01)
USPC ..... 235/404

(58) Field of Classification Search

USPC ..... 235/404
See application file for complete search history.

(56) References Cited

U.S. PATENT DOCUMENTS

| | | | |
|---|---|---|---|
| 5,824,942 | A | 10/1998 | Mladjan et al. |
| 7,121,036 | B1 | 10/2006 | Florence et al. |
| 7,124,531 | B1 | 10/2006 | Florence et al. |
| 7,210,262 | B2 | 5/2007 | Florence et al. |
| 7,292,262 | B2 | 11/2007 | Towery et al. |
| 2004/0088898 | A1 | 5/2004 | Barrett |
| 2007/0277421 | A1 | 12/2007 | Perkins et al. |
| 2011/0207089 | A1 | 8/2011 | Lagettie et al. |
| 2012/0000979 | A1 | 1/2012 | Horvath et al. |

FOREIGN PATENT DOCUMENTS

| | | |
|---|---|---|
| WO | WO2011-102894 | 8/2011 |

OTHER PUBLICATIONS

International Search Report and Written Opinion, dated Nov. 19, 2013, from related International Application No. PCT/US2013/024986.

*Primary Examiner* — Daniel Hess
(74) *Attorney, Agent, or Firm* — Greenberg Traurig, LLP

(57) ABSTRACT

A digital targeting scope apparatus includes an image sensor and a lens for acquiring video images of objects at which the aiming device is aimed; an image processor; a tilt sensor; and a display component for displaying the video images captured by the image sensor, all mounted in a tubular housing. An interchangeable digital camera module is carried by the first end of the housing. A control/display module is removably fastened to the second end of the housing. The control/display module is electrically connected to the camera module through a connector on the sensor circuit board of the camera module when the control/display module is installed in the second end of the housing. The control portion includes a circuit board and a display component mounted thereon. The display portion houses an eyepiece lens assembly aligned with the display component.

12 Claims, 12 Drawing Sheets

DIGITAL TARGETING SCOPE APPARATUS

CROSS REFERENCE TO RELATED APPLICATIONS

This application is a continuation in part of U.S. Non-Provisional application Ser. No. 13/412,506, filed Mar. 5, 2012, the content of which is hereby incorporated by reference in its entirety.

BACKGROUND OF THE DISCLOSURE

1. Field of the Invention

This invention is directed to aiming devises, in general, and to aiming devices with electronically enhanced target acquisition capabilities, in particular.

2. Prior Art

When making a long range shot with a firearm, the shooter must first determine a firing solution based on distance to target (Range), bullet drop due to the flight characteristic of the bullet and gravity (Drop), and crosswind component of the wind that is blowing at the time of firing (Windage).

Typically, the shooter will have a chart taped to the side of his weapon, or will have memorized the values for each of the corrections i.e. Drop and Windage at various Ranges and wind velocities. The shooter must then make a correction for each of these component values. Two methods are commonly used for this purpose. The first is to manually adjust the turrets on an optical aiming device so that the reticule is directing the shooter to the corrected target position. The second alternative is to use what is commonly called "Holdover" by those skilled in the art. There are many types of optical aiming devices that have graduated reticules for this purpose. The shooter places the target at a different position on the reticule based on its graduations.

There are numerous "Optical solutions" to the "Automatic Firing solution" problem sited in previous patents; however, few seldom survive in the marketplace because of the high cost of automatically moving optical components and the difficulty of maintaining accuracy with repeated impact from a weapon.

SUMMARY OF THE DISCLOSURE

A first embodiment of the targeting device or apparatus in accordance with the present disclosure includes an image sensor and a lens for acquiring video images of objects at which the aiming device is aimed; an image processor; a tilt sensor for sensing the force of gravity in relation to the aiming device; a display component for displaying the video images captured by the image sensor, and processed by the image processor; a eyepiece lens to allow the user to view the display component; a pressure and temperature sensor to sense atmospheric conditions, and suitable means to house said components.

The apparatus provides a completely "Solid state digital" and "Hands Free" solution to the task of accurately firing a weapon at long range. The shooter is able to input all of the necessary information to make a long range shot at the time of firing without removing his hands from the weapon, by simply tilting the weapon from side to side.

A predetermined threshold angle defines the tilt function. For purposes of explanation, let us say this is 10 degrees. If the tilt angle of the weapon is less than 10 degrees in either direction i.e. left or right, a calculation is made for cross-windage adjustment. A representation of the amount of cross-windage adjusted for, is superimposed; along with a suitable crosshair symbol to define aim point, on a video image presented to the shooter. If the tilt angle is greater than 10 degrees in either direction, a range number superimposed on the video image, is progressively increased or decreased dependent on the direction and magnitude of the tilt angle greater than 10 degrees. The field of view i.e. (the magnification power) of the video image presented to the shooter is simultaneously increased or decreased in relation to the Range number, if the field of view is within field of view limits defined by the front lens and the image sensor.

A Range finding circle is also superimposed on the video image. This circle represents a predetermined target size. The circle remains a fixed size on the display component, if the field of view is greater than its minimum. If the field of view is at minimum, the Range finding circle size is progressively adjusted to a smaller size in relation to the Range setting. To find the distance to target, the shooter adjusts the range setting by tilting the weapon more than 10 degrees left or right until the target fits the range finding circle.

As described above, the apparatus provides a durable aiming device with no visible external controls. All ballistic calculations necessary for long-range shooting are performed automatically in relation to internal sensors and settings performed by tilting the weapon; thereby, rendering a simple and easy to use aiming device. Another embodiment in accordance with the present disclosure is a digital targeting scope apparatus that includes a tubular housing having a central axis and a first end and a second end and an interchangeable digital camera module carried by the first end of the housing. The camera module includes at least one focusing lens axially spaced from an image sensor mounted normal to a lens axis on a sensor circuit board within the camera module. An image projected by the lens focuses at a predetermined location on the sensor. A control/display module having a longitudinal axis is removably fastened to the second end of the housing. The control/display module is electrically connected to the camera module through a connector on the sensor circuit board of the camera module. Connection is made when the control/display module is installed in the second end of the housing. The control/display module has a control portion including a circuit board and a display component mounted thereon and includes a display portion housing an eyepiece lens assembly aligned with the display component.

The control portion of the control/display module preferably has a power source, a tilt sensor, an external computer connector, an image processor, a memory and a pair of switches all connected to a printed circuit on a printed circuit board oriented axially in the control/display module. The camera module and control/display module are coaxially aligned in the tubular housing. The control/display module is configured to permit a user to select between settable preprogrammed parameters when the control/display module is separated from the camera module and rotated about its longitudinal axis. The selection of one or more of the preprogrammed parameters is made by actuation of one or more of the pair of switches.

A tilt sensor in the control/display module is configured to measure a tilt angle of the device about the housing axis and cause the image processor to produce an adjusted target image in response to the measured tilt angle. The image processor is configured to generate a change in display image field of view upon receipt from the tilt sensor of a measured tilt angle greater than a threshold angle. A tilt angle greater than zero and less than the threshold angle causes a windage adjustment indicator in the display image field of view to change position.

The control/display module is configured to permit a user to select between settable preprogrammed parameters when the control/display module is separated from the camera module and horizontally held and rotated about its longitudinal axis.

DETAILED DESCRIPTION

Reference will now be made in detail to the accompanying drawings, which at least assist in illustrating pertinent embodiments of the new technology provided for by the present disclosure.

Figure 1:
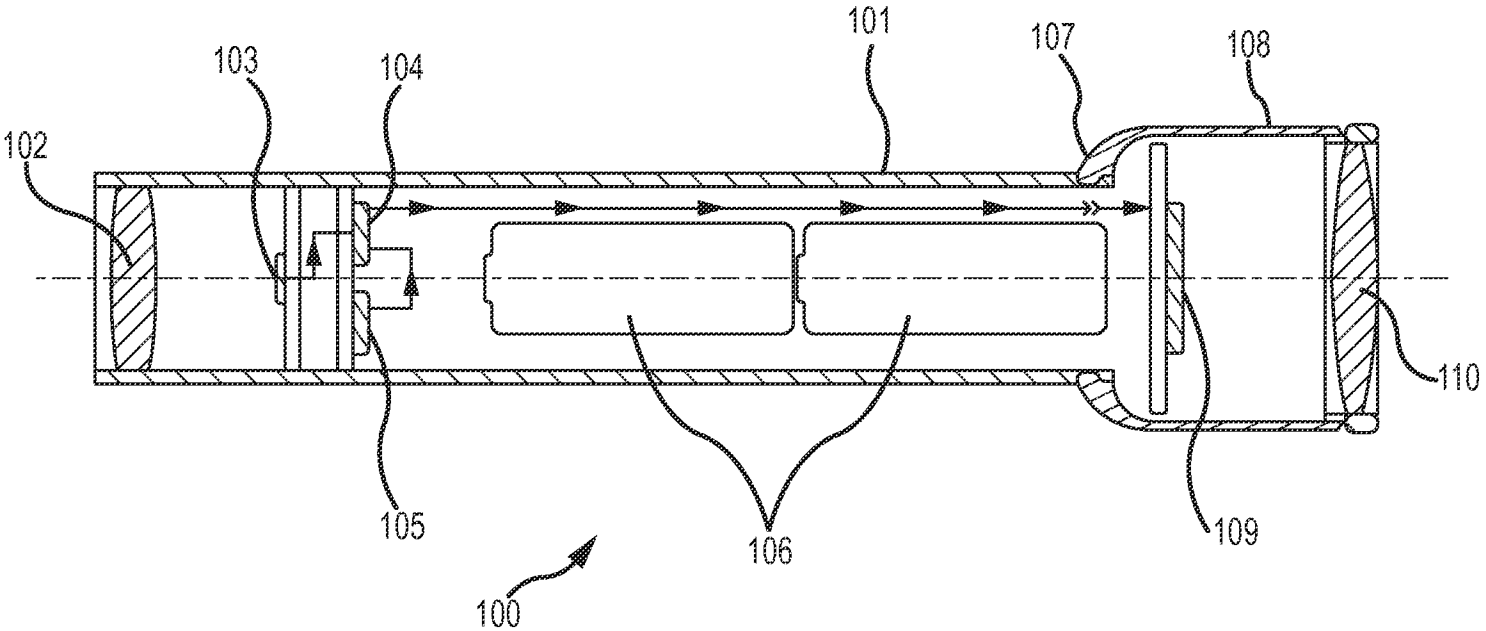
FIG. 1 is a partial, cross-sectional, schematic view of one embodiment of a digital targeting scope in accordance with the present disclosure.

Referring now to FIG. 1, one embodiment of a digital targeting scope system 100 is illustrated. In the illustrated embodiment, the system 100 includes an elongated, hollow, tubular housing 101 having a front end and rear end. The housing may be fabricated from anodized aluminum or the like. A front lens 102 and an image sensor 103 are mounted proximal the front end of the housing 101. The front lens 102 is mounted so as to focus light from a target onto the image sensor 103. An image processor 104, a tilt sensor 105, and batteries 106 are mounted within the tubular housing 101. The image sensor 103 and tilt sensor 105 are in electrical communication with the image processor 104. A control/display module 108 and an image display component 109 are mounted proximal the rear end of the housing 101. The image display component 109 is in electrical communication with the image processor 104. The housing 101 may also include an integral mounting system (not pictured) for the purpose of mounting the aiming device 100 to a weapon (e.g., a rifle).

In this exemplary embodiment, the image sensor 103 is operable to obtain raw image data of the target. The image processor 104 is operable to receive the raw image data from the image sensor 103 and produce a target image based thereon. The image display component 109 is operable to receive the target image from the image processor 104 and display the target image to a user, which may facilitate aiming of the weapon.

The tilt sensor 105 is operable to measure the tilt angle of the aiming device 100 and produce angular position data based thereon. As used herein, "tilt angle" means the rotational orientation of the aiming device 100 about the center axis of the tubular housing 101. Tilt angle is expressed as the amount, in degrees, of rotational displacement (i.e., angular displacement) of the device while positioned on a horizontal axis through the device from a reference orientation (e.g., vertical). In one embodiment, the tilt sensor is an accelerometer.

The image processor 104 preferably includes a microprocessor and memory storing static information and dynamic information, along with software that is operable to receive the angular position data from the tilt sensor 105 and make adjustments to the target image display based thereon. Thus, changing the tilt angle, for example via a clockwise/counterclockwise rotation of a weapon attached to the aiming device 100, while the weapon is pointed or aimed along an axis through the weapon's barrel, may facilitate control of one or more aiming functions associated with the device.

The static information stored in the image processor 104 memory includes coordinates of the optical focal point location on the image sensor 103. Since the image sensor 103 is a two dimensional array of photosites known as pixels, the x-y coordinates of the focal point of the lens on the array defines the reference position of the center of the image for display. These coordinates are burned into nonvolatile memory of the image sensor In the illustrated embodiment of FIGS. 1 and 2, changing the tilt angle may control such aiming functions as field of view adjustment, drop correction, and/or windage correction. A threshold tilt angle may define the separate functions of the aiming device 100. In one embodiment, the user may control the field of view (i.e., the effective magnification) of the target image displayed by applying a tilt angle greater than the threshold angle to the aiming device 100. When the tilt sensor 105 senses that the tilt angle is greater than threshold angle in either direction, the image processor 104 may respond by adjusting the field of view. Whether the field of view is increased or decreased and the rate at which it does so may depend on the direction and magnitude of the tilt angle.

In one embodiment, the threshold tilt angle is 10 degrees. Thus, applying a tilt angle of 30 degrees to the right (i.e., clockwise) may cause the field of view to rapidly decrease (i.e., increasing the magnification power), thereby rapidly causing the objects in the target image to appear larger to the user. Conversely, applying a tilt angle of 15 degrees to the left (i.e., counterclockwise) may cause the field of view to slowly increase (i.e., decreasing the magnification power), thereby slowly causing the objects in the target image to appear smaller to the user.

The field of view of the target image may have limits determined by the resolution of the image sensor 103 and the resolution of the image display component 109. For example the image sensor 103 may have a resolution of 2560×1920 pixels and the image display component 109 may have a resolution of 320×240 pixels. The minimum field of view of the target image (i.e., maximum magnification) may thus be reached when the data from one pixel on the image sensor 103 controls the output of one pixel on the image display component 109. Thus at maximum magnification in the present example, the image display component 109 may display one eighth of the data collected by the image sensor 103. The maximum field of view of the target image (i.e., minimum magnification) may be reached when the image display component 109, having 320×240 pixels, displays all the data collected by the image sensor 103 having 2560×1920 pixels. Thus at minimum magnification in the present example, data from blocks of pixels collected by the image sensor 103 are combined in a process called "binning" and are then sent to control one pixel on the image display component 109. In order to perform the range finding function with a high degree of resolution, the field of view of the target image must be progressively altered between maximum and minimum in small steps. Thus, the field of view of the image sensor 103 will vary from 2560×1920 pixels to 320×240 pixels in small steps, and the resolution of the image displayed by the image display component 109 will remain fixed at 320×240 pixels. Thus, in one exemplary embodiment, the aiming device has a variable magnification ratio of 8 to 1.

Figure 2:
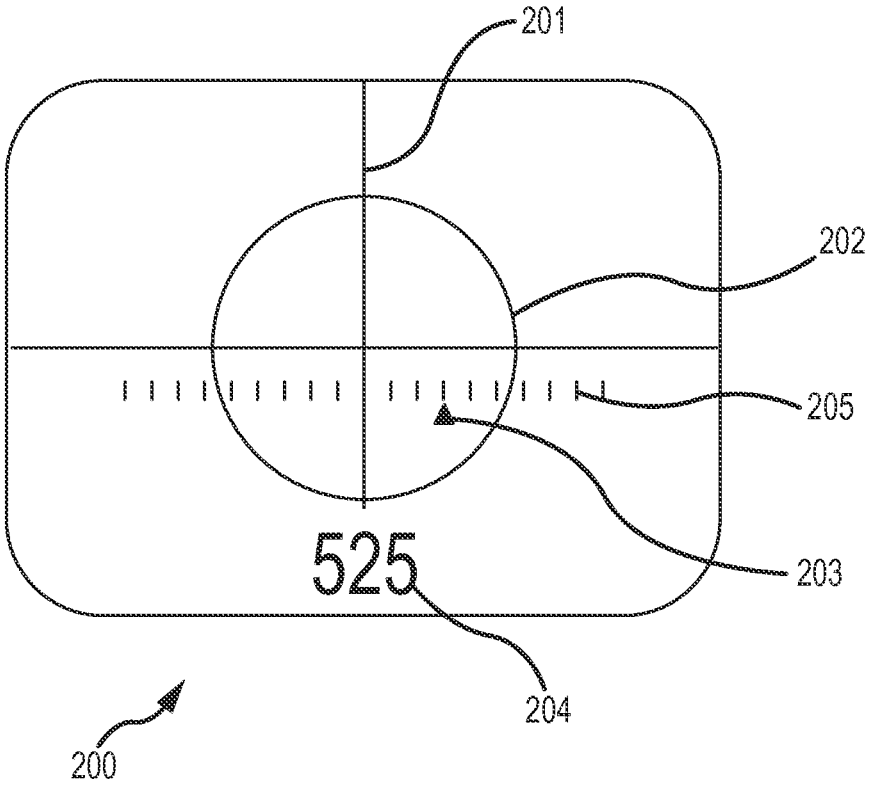
FIG. 2 illustrates one embodiment of a target image overlay of the digital targeting scope of FIG. 1.

Referring now to FIG. 2, one embodiment of a target image overlay 200 is illustrated. The microprocessor 104 may superimpose the target image overlay 200 on the displayed target image. The target image overlay 200 displays information to the user which may facilitate aiming of the weapon. In the illustrated embodiment of FIG. 2, the target image overlay 200 includes crosshairs 201, range circle 202, crosswind correction symbol 203, range number 204, and tick marks 205. The crosshairs 201 are used to define an aiming position within the target image. The range number 204 displays the range. The units of measure of range can be yards or meters selectable by the user. The crosswind correction symbol 203 in conjunction with tick marks 205 indicates the amount of crosswind corrected for in miles per hour or kilometers per hour. With optional English units chosen, the overlay 200, as shown, indicates that a crosswind of 3 miles per hour coming from the right is being corrected for, and a bullet drop calculated for a distance to target of 525 yards is being corrected for.

The illustrated target image overlay 200 includes a range circle 202. The aiming device 100 may measure the distance to a target (i.e., range) via the "Stadiametric method" using range circle 202. The range circle 202 represents a predetermined target size. To determine the range to the target, the field of view may be adjusted (e.g., by applying a tilt angle of greater than 10 degrees) while the size of the range circle 202 is held constant, until the image of the target appears to completely fill the range circle. The image processor 104 may then calculate the distance to the target using trigonometry. For example, three points consisting of the visible top of a target, the visible bottom of a target, and the front lens 120 define a right triangle. The distance from the top to the bottom of the target defines a first side of the triangle. The range circle provides a measurement of the angle opposite the first side. Thus the, image processor 104 may calculate for the length of the adjacent side of the triangle, i.e., the distance to the target.

At very long distances to the target, the image of the target may not be large enough to fill the range circle 202 even at maximum magnification (i.e., minimum field of view). Thus, in one embodiment, when maximum magnification has been reached, the image processor 104 may begin to reduce the size of the range circle 202 in response to continued input to reduce the field of view (e.g., continuing to hold the aiming device 100 at an angle beyond the threshold angle). Thus, range finding may be facilitated even at distances beyond the maximum magnification.

The effect of gravity on a bullet (i.e., bullet drop) may be calculated and corrected for by the image microprocessor 104, based on such variables as the range and ballistic data related to the bullet. The ballistic data may be input and stored in the aiming device 100. Examples of such inputs are described further below with reference to additional exemplary embodiments. To facilitate bullet drop correction, the image processor 104 may shift the target image up relative to the crosshairs 201, based on the calculated bullet drop, thereby causing the shooter to effectively aim at a point above the target although the image will appear to the viewer to be centered about the crosshairs.

The effect of wind on a bullet (i.e., cross-windage) may be calculated and corrected for by the image processor 104, based on such variables as the range, ballistic data, and ambient wind conditions at the time of firing. The ambient wind conditions may be measured or estimated using techniques known in the art. The cross-windage may be input into the image processor 104 by applying an appropriate tilt angle to the aiming device 100. To facilitate cross-windage correction, the image processor 104 may shift the target image horizontally relative to the crosshairs 201, based on the calculated cross-windage, thereby causing the shooter to aim at a point upwind of the target.

The user may control the cross-windage correction function by applying a tilt angle of less than the threshold angle to the aiming device 100. The magnitude and direction of the tilt applied to the aiming device 100 may control the magnitude and direction of the cross-windage input, thus controlling the cross-windage correction. For example if the threshold tilt angle is 10 degrees, a tilt angle of 5 degrees to the right (i.e., clockwise) may correspond to a cross-windage correction appropriate to compensate for a 10 mph wind coming from the user's right side. Whereas, a tilt angle of 3 degrees to the left (i.e., counterclockwise) may correspond to an appropriate cross-windage adjustment to compensate for a 7 mph wind coming from the left.

The crosswind correction symbol 203 may facilitate cross-windage correction by allowing the user to more precisely input the cross-windage. The image processor 104 may cause the crosswind correction symbol 203 to slide left and right relative to the crosshairs 201 in response to the magnitude and direction of the tilt angle, thereby indicating to the user the magnitude and direction of the cross-windage input being communicated to the image processor 104.

In addition, the image processor 104 adjusts the left to right position of the displayed target image such that the target remains centered in the crosshairs even though the line of sight of the weapon is corrected for the cross-wind indicated by the correction symbol 203. For example, in the exemplary illustration of FIG. 2, the cross-wind correction symbol 203 indicates a right-to-left cross-windage input of 3 units (e.g., mph) while the weapon barrel alignment (i.e., actual point of aim) is automatically right adjusted for this 3 MPH cross-wind because the display image seen by the shooter is shifted appropriately. Therefore the shooter must maintain this 3 unit tilt while firing the weapon to automatically correct for the cross-wind.

In order to initially align the device 100 on a weapon, such as a rifle, first it must be mounted on the weapon and "sighted in" at a known distance. The sequence of operations is outlined in FIG. 11. This procedure is used to compensate the device for mechanical alignment variations with respect to the weapon barrel. A first vertical adjustment is called correction for mechanical "elevation" at a reference distance. Typically for a rifle this is done at a target distance of 100 yards. A second adjustment, to compensate for horizontal variation in mounting is called mechanical "Windage". For the device 100, these adjustments are made in software resident on an external device such as a laptop, iPad, smartphone or PC that is connected to the microprocessor 104 in the device 100.

Figure 11:
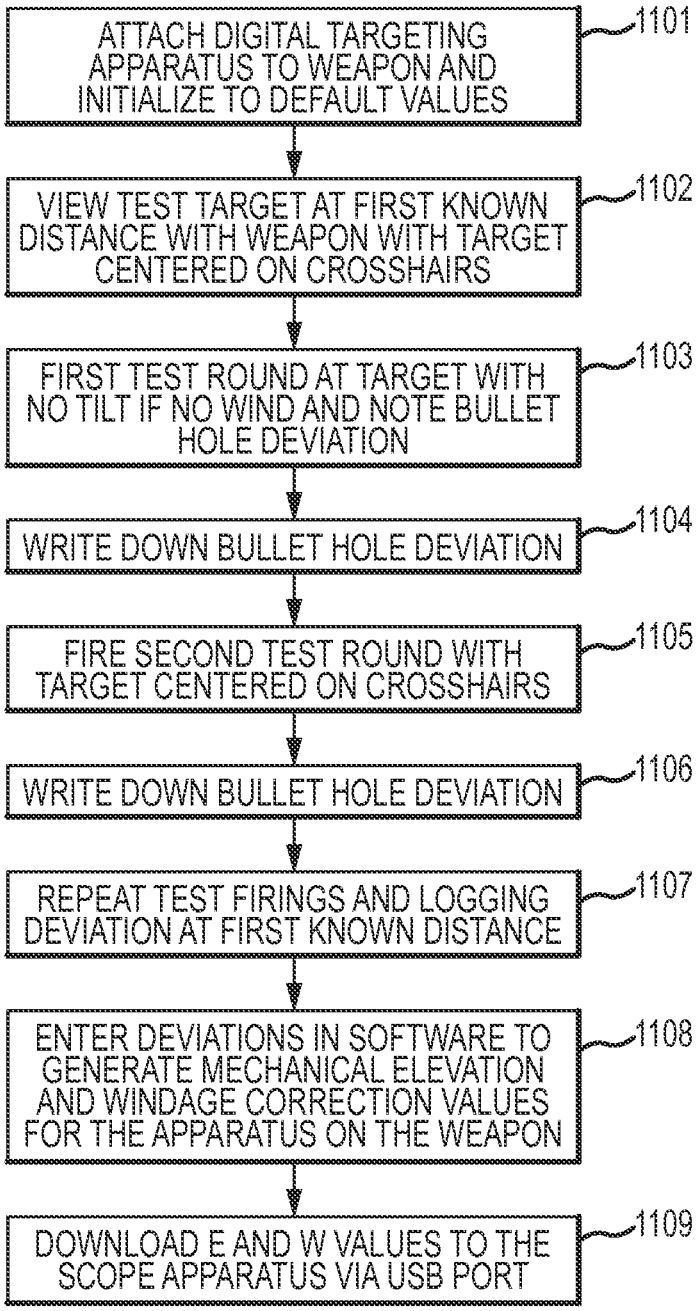
FIG. 11 illustrates the process of initially aligning or sighting in the apparatuses shown in FIG. 1 and in FIG. 3 on a weapon such as a rifle.

Initially default values assuming perfect barrel alignment, and an expected muzzle velocity (MV) value and expected ballistic coefficient (BC) are loaded as defaults in the device 100, shown as operational step 1101 in FIG. 11. Next, the weapon is taken to a target range where a target is placed at a known distance, for example, 100 yards, and the device 100 is aimed at that target in operation 1102. Preferably this is done when there is no cross-wind to affect the corrections being made. Then in operational step 1103 a first test shot is fired with the device 100 vertical (no tilt) and aimed such that the crosshairs are centered on the target image. In operation 1104 the bullet impact deviation from target center is measured and recorded. In operation 1105 a second test shot is made and in operation 1106 the bullet impact deviation from target center is recorded. These test shots are repeated several times in operation 1107. In operation 1108, all of these recorded deviation values are entered into the software to generate mechanical Elevation and Windage correction values for the apparatus 100 on the particular weapon. Finally, in operation 1109, the software determined Elevation and Windage correction values for the apparatus 100 are downloaded to the scope device 100 via its USB port.

In order to provide proper muzzle velocity (MV) and ballistics coefficient (BC) data that is tailored to the weapon, additional test firings at various distances are required. These operations are explained with reference to FIG. 12. These steps are the same as in FIG. 11 through step 1208. In operation 1209 the previous steps are repeated for several different target distances. The deviations are then entered in software in operation 1210 to generate a best fit of the data and produce accurate muzzle velocity and ballistics coefficient data for the particular cartridge being fired in the weapon. These values are then downloaded into the device 100 in operation 1211.

The software code utilized to generate the MV and BC data is based on Newtonian physics equations for projectiles that are well known. Exemplary equations for this purpose may be found in *Modern Practical Ballistics*, by Arthur J. Pejsa, Kenwood Publishing, $2^{nd}$ edition. Once these values of MV and BC are known for a particular weapon/targeting device combination, and downloaded into the image processor 104, operation of the device 100 is straightforward.

In operation, the user of the device 100 simply aims the weapon at a target, tilts the weapon more than 10 degrees counterclockwise to visually zoom in on the target, then, when appropriately sized in the display, return the weapon to vertical and tilts the weapon either slightly left or right, depending on the perceived cross-wind, and takes the shot. Range is corrected automatically via the microprocessor shifting the display image up or down. The crosshairs remain centered and the range correction is automatically provided and displayed. Cross-windage correction is automatically made by the shooter tilting the weapon to his or her estimate of the desired target offset provided by the cross-wind correction symbol 203 in the image display shown in FIG. 2. The target image is automatically shifted right or left in the display so that the crosshairs remain centered and the shooter aims at the displayed image with the crosshairs centered and takes the shot while maintaining the tilt desired, thus correcting for cross-winds.

Figure 3:
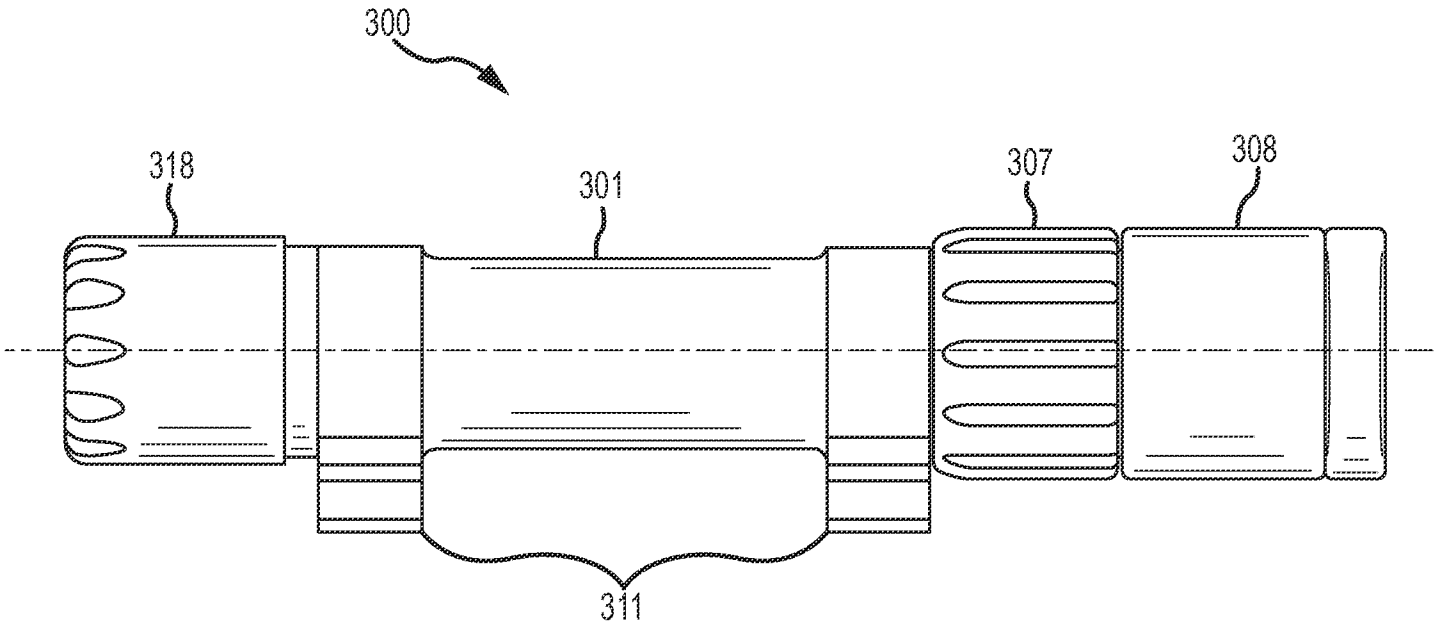
FIG. 3 is a side view of another embodiment of a digital targeting scope in accordance with the present disclosure.
Figure 4:
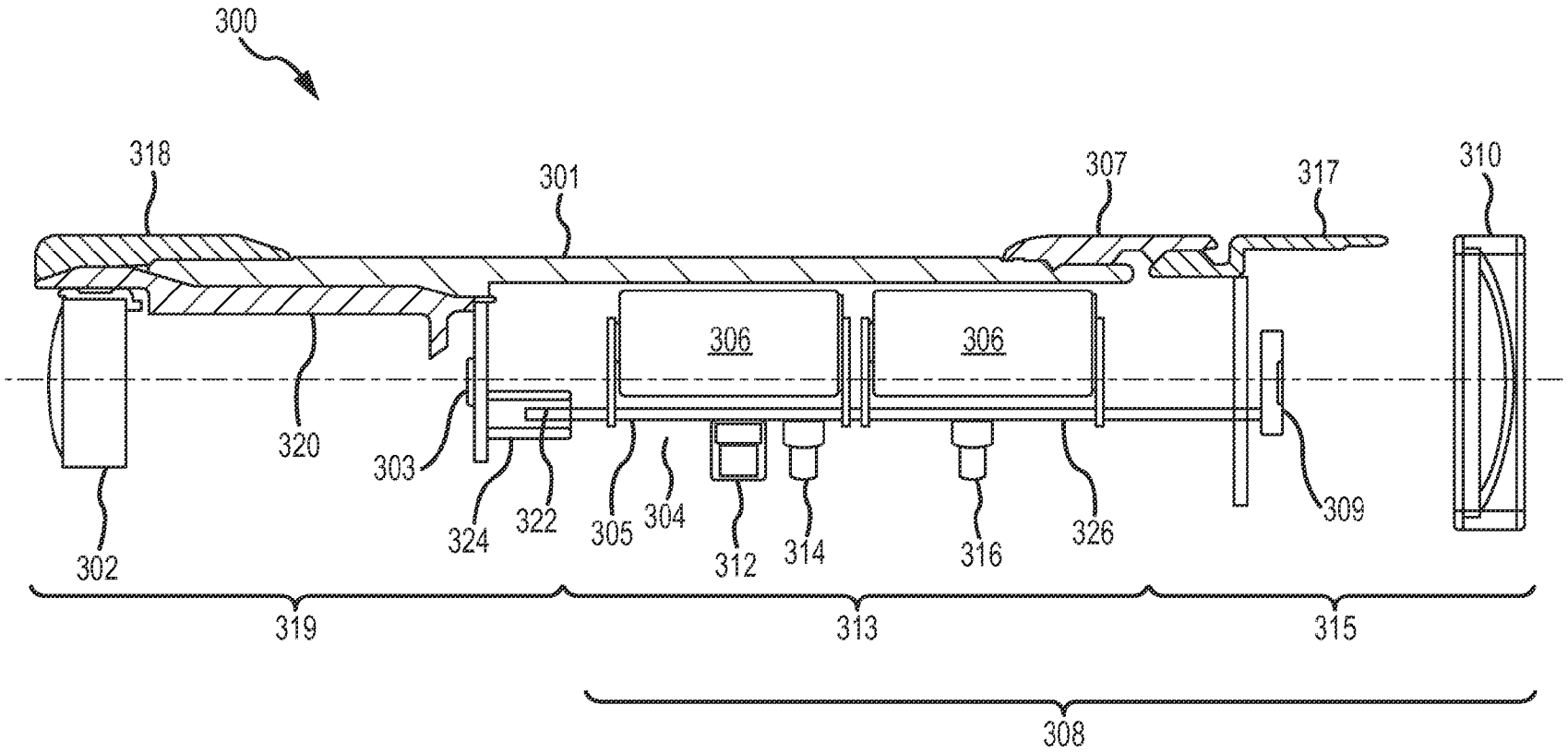
FIG. 4 is a partial, cross-sectional, schematic view of the digital targeting scope of FIG. 3.
Figure 5:
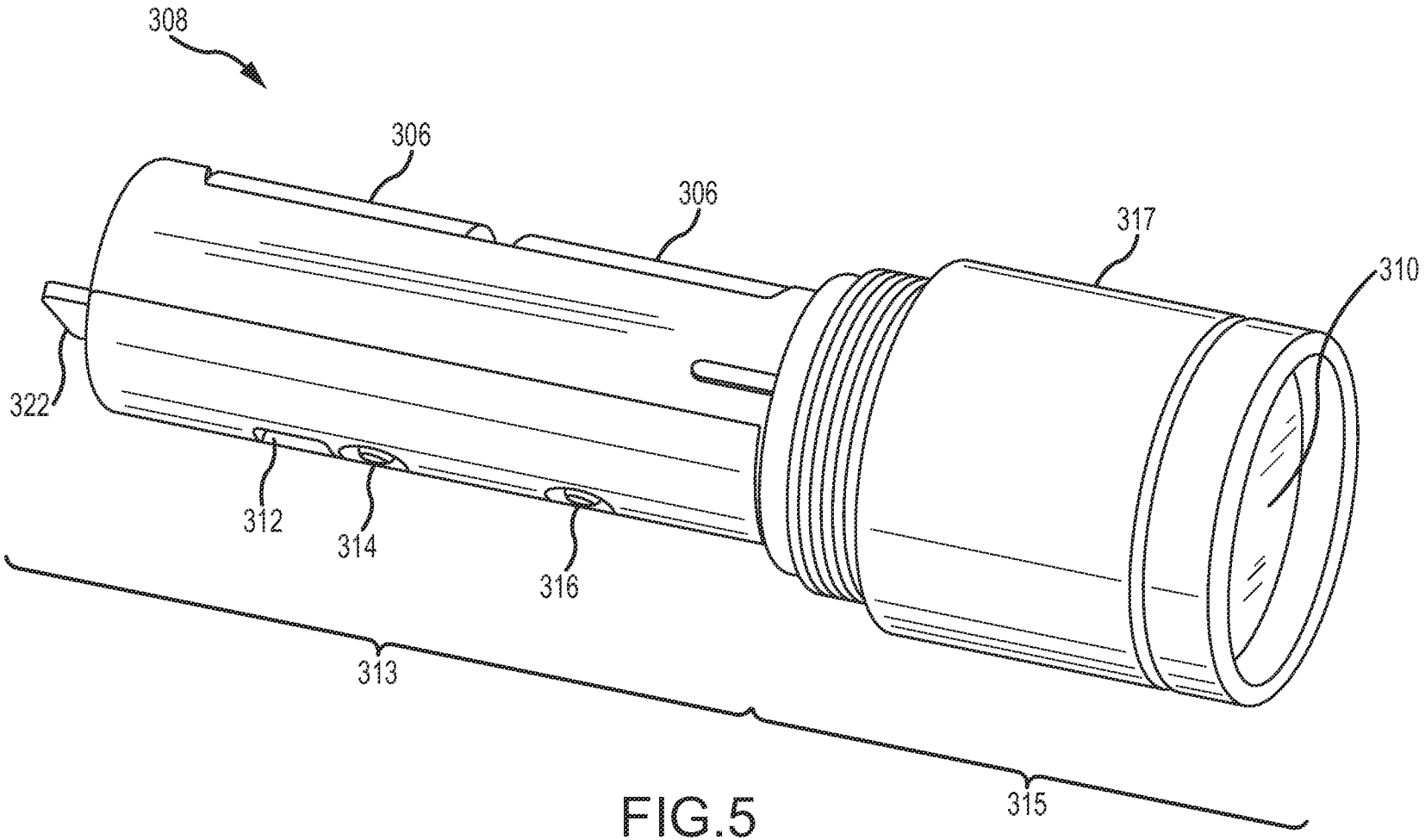
FIG. 5 is a separate perspective view a control/display module of the digital targeting scope of FIG. 3.
Figure 6:
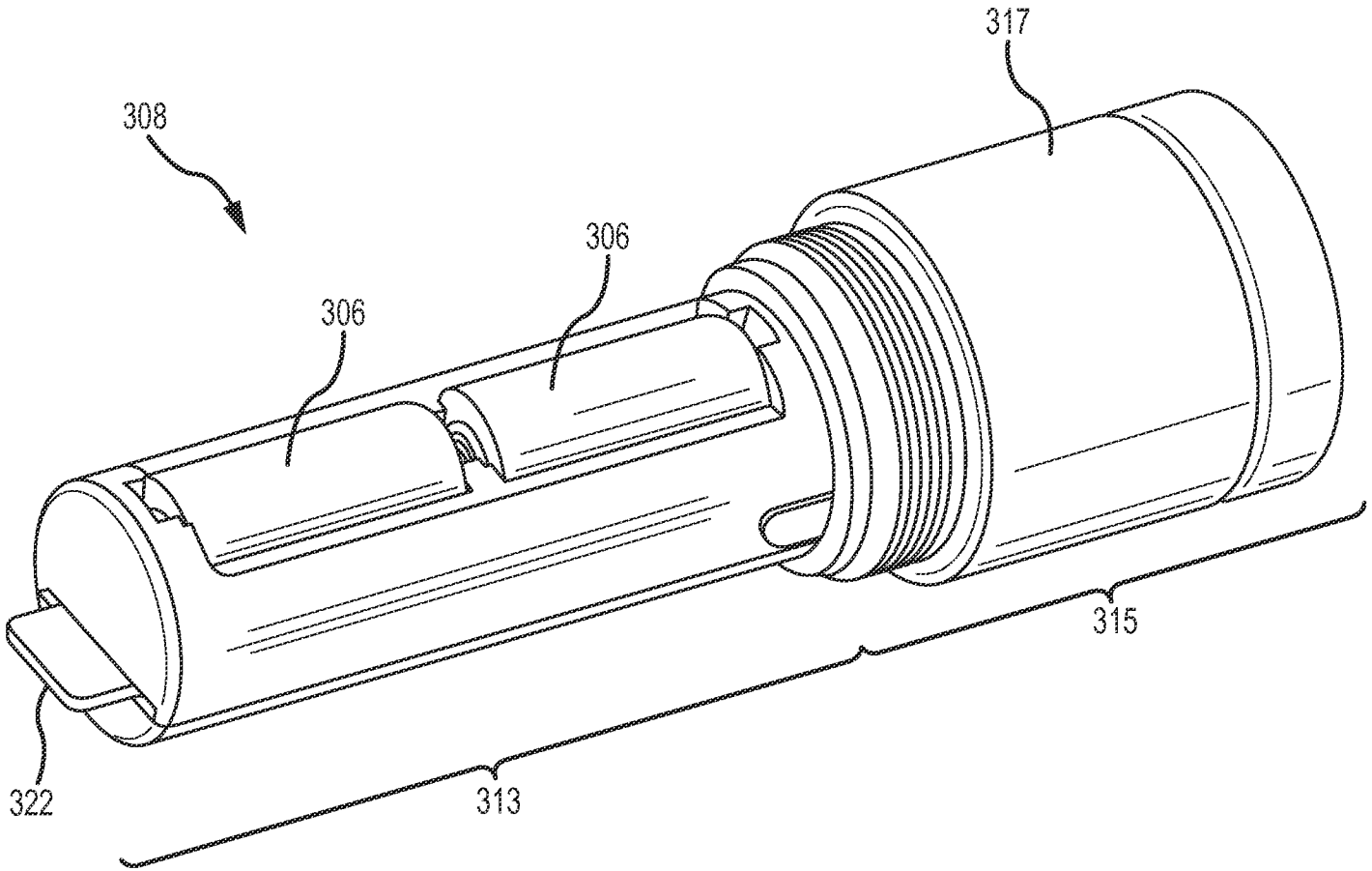
FIG. 6 is another perspective view of the control/display module as shown in FIG. 5.
Figure 7:
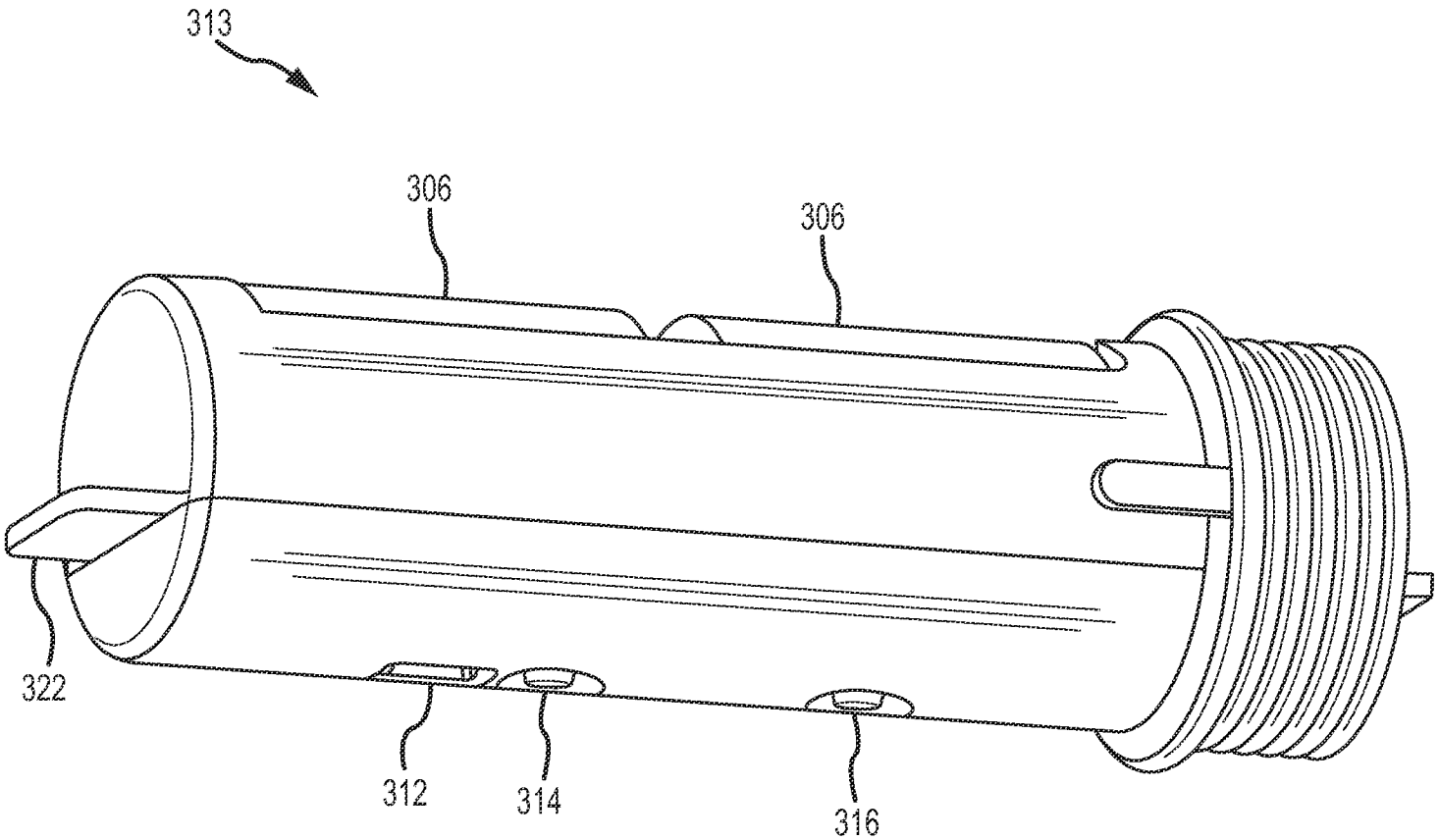
FIG. 7 is a separate perspective view of the control portion of the control/display module of FIG. 6.

Referring now to FIGS. 3-4, a second embodiment of an aiming device 300 is illustrated. In the illustrated embodiment, the apparatus 300 includes an elongated, hollow, tubular housing 301 having a front end and rear end. The housing may be fabricated from anodized aluminum or the like. A front lens 302 and an image sensor 303 are mounted in a sealed unit together proximal the front end of the housing 301. The front lens 302 is mounted so as to focus light from a target onto the image sensor 303. The front lens 302 and sensor 303 are part of a sealed interchangeable camera module 319. This image sensor 303 is mounted on a circuit board and preferably includes a sensor, an image processor and nonvolatile memory.

A microprocessor 304, pressure and temperature sensors (not shown), a tilt sensor 305, and batteries 306 are mounted to a circuit board 326 in a control/display module 308. The image sensor 303, temperature, pressure, and tilt sensor 305 are in electrical communication with the microprocessor 304 as described below.

The control/display module 308 and an image display component 309 are removably mounted proximal the rear end of the housing 301. The image display component 309 is in electrical communication with the microprocessor 304. The housing 301 also includes an integral mounting system 311 for the purpose of mounting the aiming device 300 to a weapon (e.g., a rifle).

The aiming device 300 may include some or all of the features of the first embodiment of the aiming device 100 including, for example, such features as field of view adjustment, bullet drop (range) correction, and/or cross-windage correction. In addition, the aiming device 300 preferably includes interchangeable camera modules 319 consisting of the front lens 302 and image sensor 303 in a lens barrel 320. The image sensor 303 is mounted normal to the lens axis on a circuit board fastened to a rear end of the barrel 320 and is preferably sealed thereto. The image sensor circuit board includes a coaxially rearwardly extending female connector 324 for receiving a blade pin connector extending from the forward end of the control/display module 308 described below.

Figure 9:
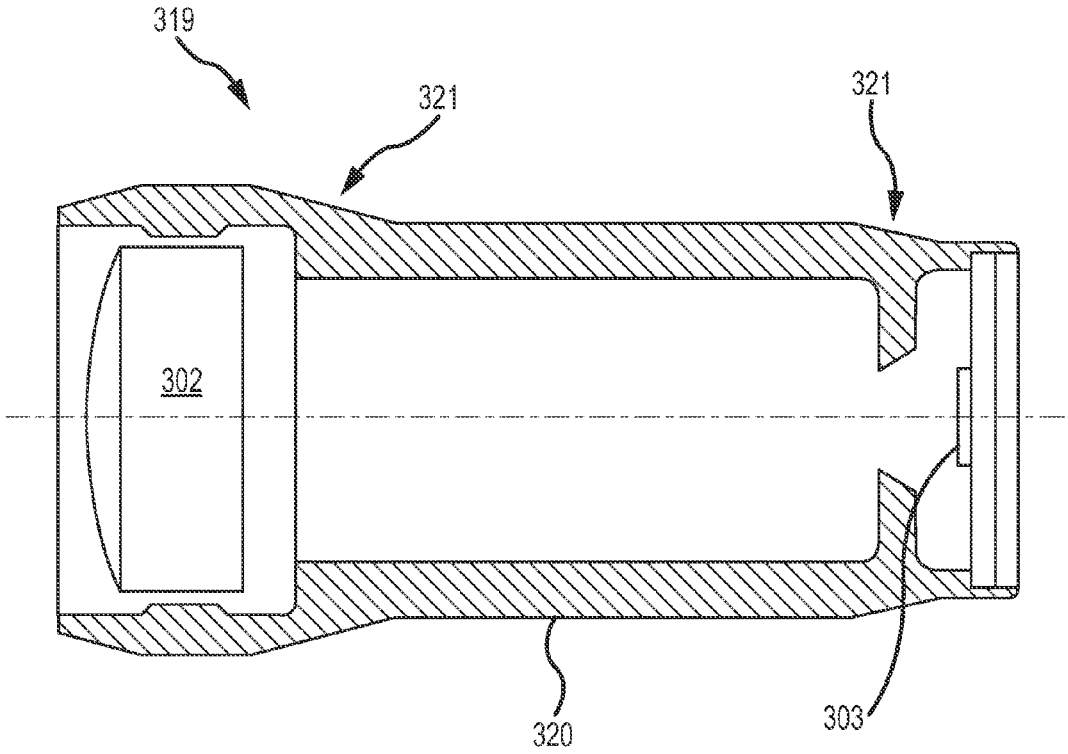
FIG. 9 is a separate, cross-sectional, schematic view of an interchangeable camera module of the embodiment of the digital targeting scope shown in FIG. 3.

The camera modules 319 are secured to the housing 301 via an external threaded collar 318 that guides and securely seats the lens barrel 320 in exact registry within the housing 301, via registration surfaces 321 (shown in FIG. 9). This interchangeable camera module feature permits one targeting apparatus or device 300 to be utilized in a variety of different circumstances such as long range or short range situations without the need to re-sight in a different camera module 319. This can be very advantageous to a user.

Referring now to FIGS. 5-8, one embodiment of a removable control/display module 308 is illustrated. The control/display module 308 is removably mounted to the rear end of the elongated tubular housing 301 by a collar 307. Removal of the control/display module 308 from the tubular housing 301 may facilitate battery replacement and/or facilitate configuration of device settings, as described below. The collar 307 may employ bayonet type, threaded, or any other suitable mounting system that can maintain mechanical connection between control/display module 308 and the tubular housing 301 during the firing of the weapon.

The front opening of the collar 307 fits over the outer surface of the rear end of the tubular housing 301. The outer surface of the rear end of the tubular housing 301, in this exemplary embodiment, includes an annular groove. The inner surface of the collar 307 includes a annular rib configured to fit within the groove such that the collar 307 is rotatably mounted to the tubular housing 301. The inner surface of the rear opening of the collar 307 is threaded. The outer surface of the front end of the control/display module 308 is similarly threaded such that the control/display module 308 may be threadably mounted to the tubular housing 301 via rotation of the collar 307. Thus, the collar 307 allows the control/display module 308 to be connected and disconnected to the tubular housing 301 without rotation of the control/display module 308 in relation to the tubular housing 301. This, in turn, allows for use of plug or bayonet type electrical connections between the control/display module 308 and the camera module 319.

The control/display module 308 includes an eyepiece lens assembly 310. The eyepiece lens assembly 310 facilitates viewing of the image display component 309. In one embodiment, the distance from the eyepiece lens in the eyepiece lens assembly 310 to the image display component 309 may be manually adjustable to facilitate diopter adjustment. For example, the eyepiece lens assembly 310 may be threadably mounted in the control/display module 308 such that clockwise rotation of the eyepiece lens assembly 310 causes the distance from the eyepiece lens to the image display component 309 to decrease, and vice versa.

Figure 8:
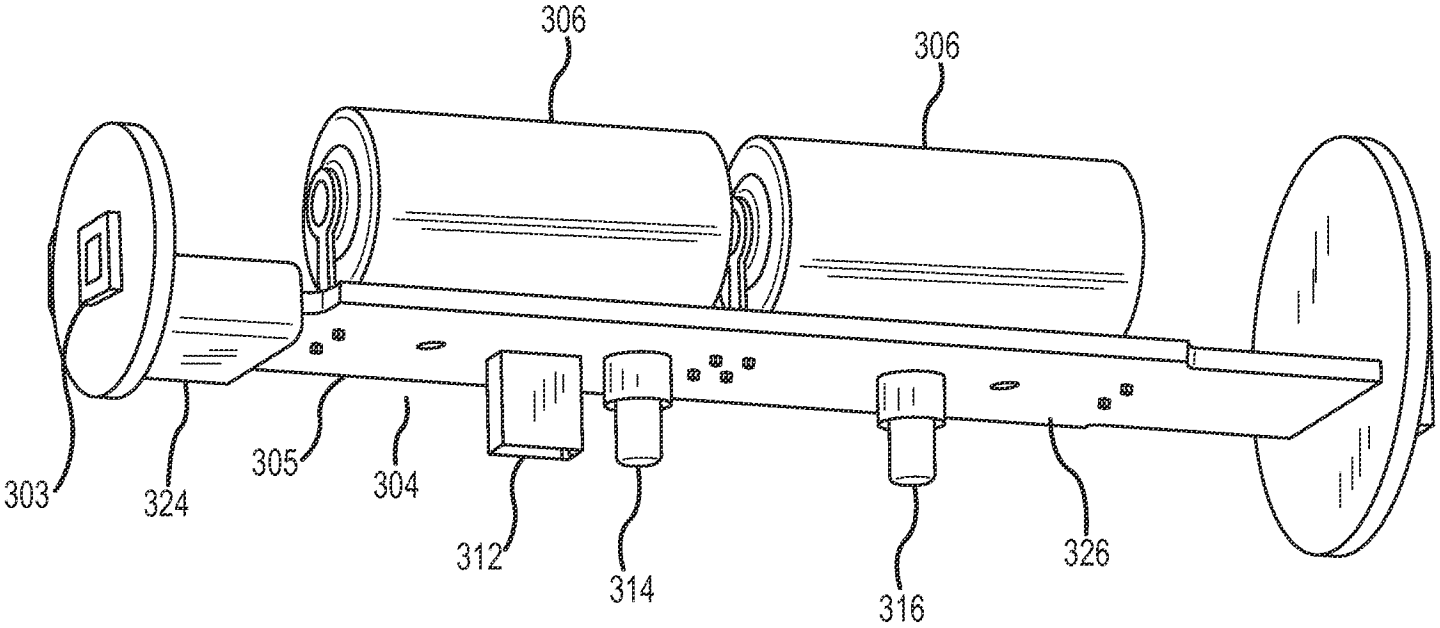
FIG. 8 is a perspective view of the control portion of the control/display module of FIG. 6, showing the sensor circuit board connected to the control portion.

As is best shown in FIG. 8, the control/display module includes control portion 313 that contains a circuit board 326 to which the batteries 306, a tilt sensor, a pressure sensor, and a temperature sensor are attached and which connect with the microprocessor 304 which in turn connects to the display element 309 in the display portion 315 of the control/display module 308. The front end of the circuit board 326 includes a male blade connector 322 that mates with the female connector 324 to solidly connect the image sensor 303 with the microprocessor 304 that is mounted on the circuit board 326 when the control/display module 308 is installed within the housing 301 as above described.

Separation of the control/display module 308 from the tubular housing 301 allows the user to input information to be stored in electronic memory of the microprocessor 304. Such information may include ballistic data, for example ambient temperature, pressure, the muzzle velocity, drag, and/or ballistic coefficient associated with one or more bullet types. In the exemplary embodiment 300, removal of the control/display module 308 from the tubular housing 301, exposes a computer connection port 312 that is in electronic connection with the processor 304 via circuit board 326. In one embodiment, the computer connection port 312 is a USB port. The control/display module 308 may thus be connected to a computer having appropriate application software capable of communicating with the processor 304, via computer connection port 312. Ballistic data for one or more bullet cartridge types may then be input and stored in the aiming device 300 for use related to in-the-field bullet trajectory calculations by processor 304 to facilitate aiming of the weapon as described above.

Turning now to FIG. 9, one embodiment of an interchangeable lens module 319 is shown. In the illustrated embodiment, the lens module includes lens barrel 320 having registration surfaces 321. The registration surfaces 321 facilitate proper alignment of the interchangeable lens module 319 in the housing 301. As noted above, the image sensor 303 preferably includes nonvolatile memory. The nonvolatile memory stores the coordinates (x,y) of the pixel within the array of pixels of the image sensor 303 that lies along the line of sight of the camera module 319 (referred to herein as the "reference pixel"). When the interchangeable lens module 319 is installed in the apparatus 300, the microprocessor 304 may be operable to read the coordinates of the reference pixel to establish a reference point on the target image. Thus, each of the interchangeable lens modules 319 that may be installed in the apparatus 300 is self-contained and sealed. Further, the variable characteristics described herein are not affected by changing of the camera modules 319.

Due to slight manufacturing defects (e.g., lens imperfections), this line of sight of the camera module 319 may not be exactly coincident with the longitudinal center axis of the camera module 319. Preferably, the reference pixel is determined as a final step in the process of manufacturing the lens module 319. To determine the reference pixel, the interchangeable lens module 319 may be connected to a calibration apparatus (not shown) that includes surfaces that mate with registration surfaces 321. The calibration apparatus further includes a calibration target positioned such that when the interchangeable lens module 319 is mounted in the calibration apparatus, the center axis of the lens module 319 is pointed at the calibration target. An image of the calibration target may then be obtained via the sensor 303. The reference pixel may then be located by analyzing the image to determine which pixel of the sensor 303 captured the light emanating from the center of the calibration target. The coordinates of the reference pixel may then be stored (e.g., "burned") in the nonvolatile memory of the image sensor 303 via the calibration apparatus.

Figure 10:
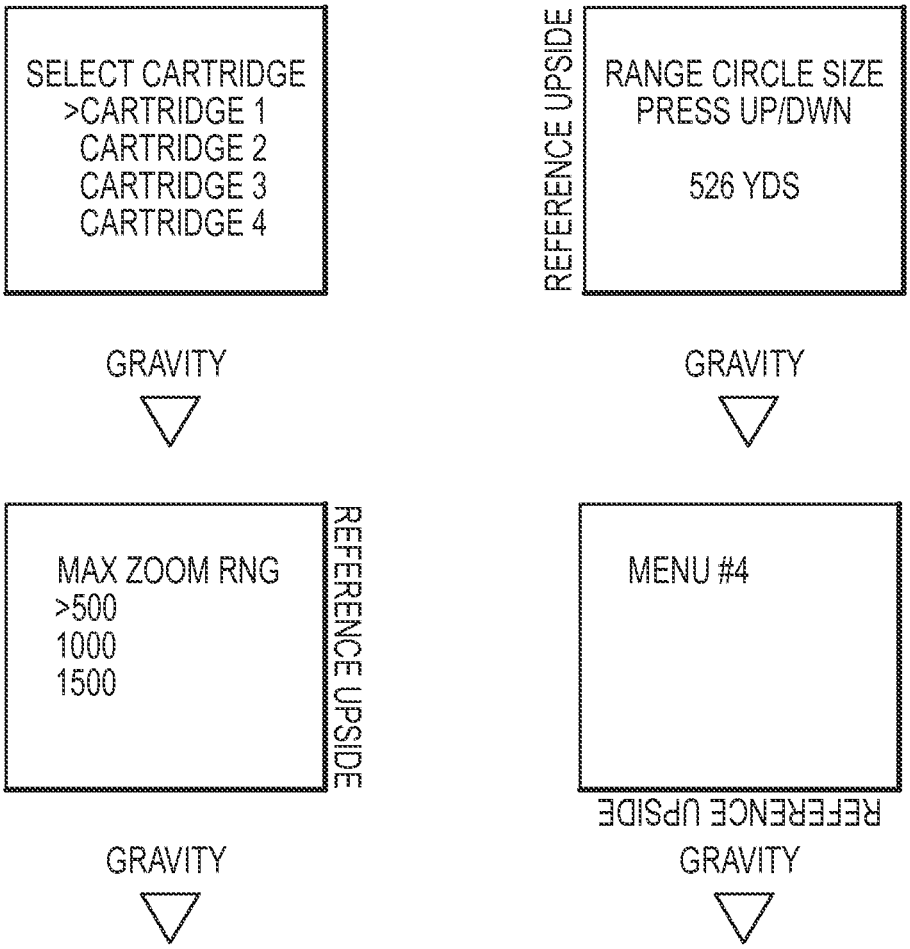
FIG. 10 illustrates four representative displays provided by the control/display module of the digital targeting scope of FIG. 3.

Referring now to FIG. 10, four exemplary menu displays provided by the control/display module of the digital targeting scope are illustrated. In one embodiment of the control/display module 308, separation of the control/display module 308 from the tubular housing 301 allows the user to make in-the-field selections of such functions as size of range circle 202, maximum zoom range and bullet type.

These functions are preferably organized into menus. For example, a cartridge menu may display several cartridge types. Changing the cartridge type on the menu causes the ballistic data, MV and BC values, used in trajectory calculations by the processor 304 to correspondingly change.

In one embodiment, the user may step through the various menus by changing the tilt angle of the separated control/display module 308. For example a first menu appears at a tilt angle of 0 degrees, a second menu appears at a tilt angle of 90 degrees, a third menu appears at a tilt angle of 180 degrees, and a fourth menu may be presented at a tilt angle of 270 degrees. The user may step through the various options within each menu via use of the push buttons 314, 316. Thus, the user may make in-the-field changes to such functions as size of range circle 202, maximum zoom range and ballistic data associated with one or more bullet cartridge types.

Turning the aiming device 100 or 300 on is preferably accomplished by removing a front lens cover (not described) from the aiming device. Putting the aiming device in a low power standby state is accomplished by replacing a front lens cover on the aiming device. Naturally, removing the batteries will disable the device for storage, but will not erase static information stored in nonvolatile memory.

Figure 12:
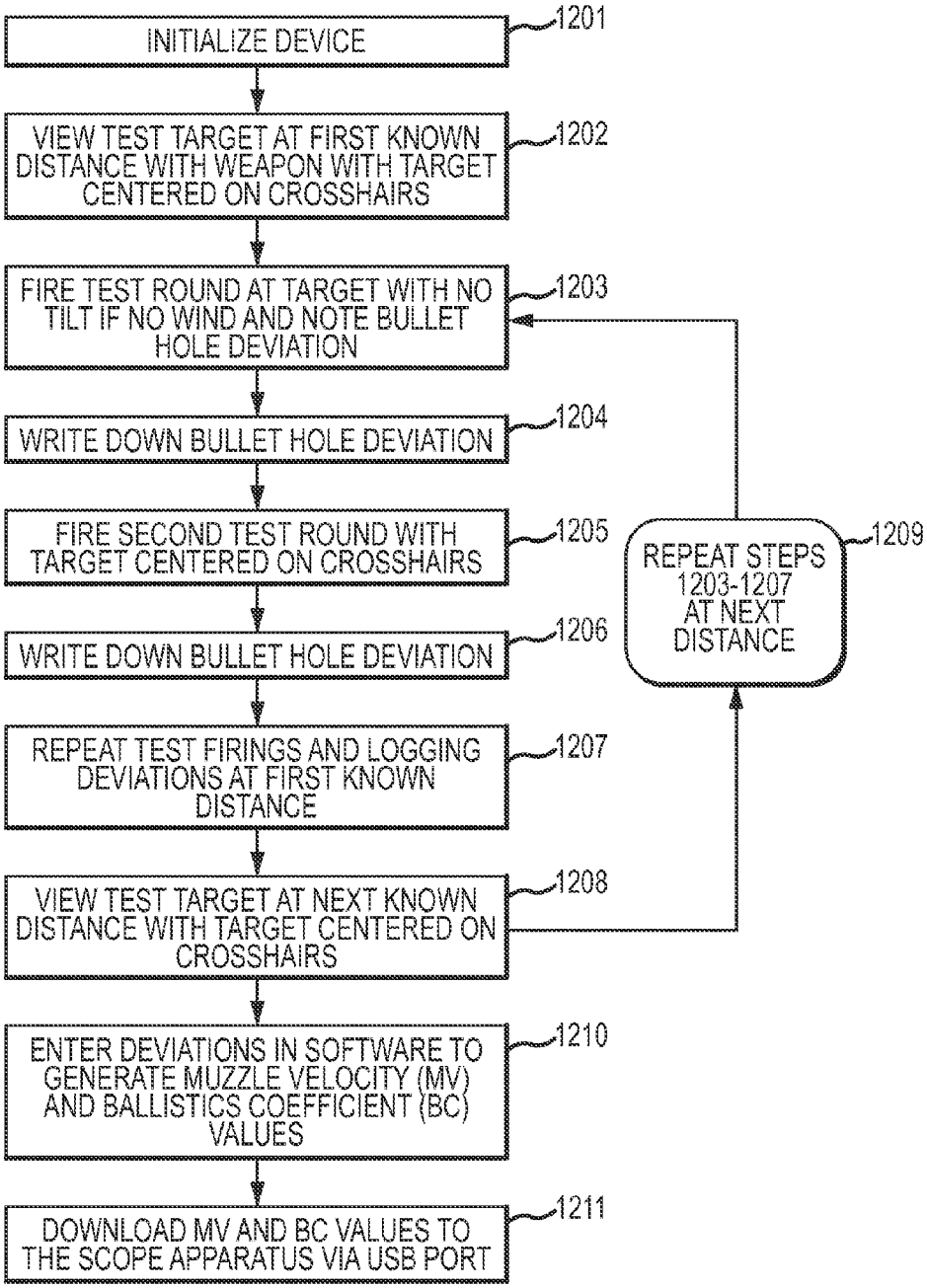
FIG. 12 illustrates the process of determining the muzzle velocity (MV) and ballistic characteristic (BC) values for the apparatuses shown in FIG. 1 and FIG. 3 on a specific weapon such as a rifle for various distances.

Referring now to FIGS. 11 and 12, the aiming device 300 may be sighted in for each of up to four types of cartridge/bullet combinations to be used in the weapon. In order to initially align the targeting apparatus 300 on a weapon such as a rifle, as with the first embodiment described above, first it must be mounted on the weapon and "sighted in" at a known distance. The sequence of operations is outlined in FIG. 11. This procedure is used to compensate the device for mechanical alignment variations with respect to the weapon barrel. A first vertical adjustment is called correction for mechanical "bullet drop" at a reference distance. Typically for a rifle this is done at a target distance of 100 yards. A second adjustment, to compensate for horizontal variation in mounting is called mechanical "windage". For the device 300, these adjustments are made in software resident on an external device such as a laptop, iPad, smartphone or PC that is then downloaded to the microprocessor 304 in the device 300 via USB port 312 on the Control/display module 308 when it is removed from the housing 301.

Initially default values assuming perfect barrel alignment, and an expected muzzle velocity (MV) value and expected ballistic coefficient (BC) are loaded as defaults in the device 300, shown as operational step 1101 in FIG. 11. Next, the weapon is taken to a target range where a target is placed at a known distance, for example, 100 yards, and the device 300 is aimed at that target in operation 1102. Preferably this is done when there is no cross-wind to affect the corrections being made. Then in operational step 1103 a first test shot is fired with the device 300 held vertical (no tilt) and aimed basically horizontally such that the crosshairs are centered on the target image. In operation 1104 the bullet impact deviation from target center is measured and recorded. In operation 1105 a second test shot is made and in operation 1106 the bullet impact deviation from target center is recorded. These test shots are repeated several times in operation 1107. In operation 1108, all of these recorded deviation values are entered into the software to generate mechanical Elevation and Windage correction values for the apparatus 300 on the weapon. Finally, in operation 1109, the software determined Elevation and Windage correction values for the apparatus are downloaded to the scope device 300 via its USB port.

In order to provide proper muzzle velocity (MV) and ballistics coefficient (BC) data that is accurately tailored to the weapon, additional test firings at various distances are required. These operations are explained with reference to FIG. 12. These steps are the same as in FIG. 11 through step 1208. In operation 1209 the previous steps are repeated for several different distances. The deviations are then entered in software in operation 1210 to generate a best fit of the data and produce accurate muzzle velocity and ballistics coefficient data for the particular cartridge being fired in the weapon. These values are then downloaded into the device 300 in operation 1211.

This process as is described in reference to FIG. 12 must then repeated for up to 4 different cartridge load/bullet combinations, since the MV and BC values will be different for each combination. Once this process is completed, the device 300 will have "learned" the precise muzzle velocity and ballistic coefficients needed for accurate operation of the targeting apparatus 300. In order to perform accurate cross-windage correction calculations, we need to have range, tilt, MV, BC, and air density values. Range is manually set via tilting the apparatus 300 and weapon, e.g., greater than 10 degrees until the image of the target properly fills the image circle in the display. The gun is then reverted to less than 10 degrees, perhaps vertical if there is no cross-wind at the time of firing. If there is a cross-wind, the shooter simply tilts appropriately and re-aims according to the cross hairs 201 and the cross-wind correction symbol 203 in the displayed image, and takes the shot. Temperature and atmospheric pressure are both critical to accurate determination of air density.

It is important to note that when the control/display module 308 is installed within the housing 301, temperature and pressure values may no longer reflect accurately the environmental conditions. Hence the control/display module should not be installed until at the shooting site, or at least temporarily removed when arriving at the shooting site so that proper temperatures and pressures can be reflected. Upon arriving at the shooting site, the user may remove and reset the batteries 306 to reset the control/display module 308, thereby causing the pressure and temperature values to be measured and stored before the control/display module 308 is re-installed within the housing 301. Because of the contacts 322, when the control/display module is fully installed, both the sensor 303 and its microprocessor and the microprocessor 304 knows that the camera module 319 is connected and therefore knows to present video when the lens cover is removed.

In operation, the user of either of the devices 100 or 300 simply aims the weapon at a target, tilts the weapon more than 10 degrees counterclockwise to visually zoom in on the target, then, when appropriately sized in the display, return the weapon to vertical and tilts the weapon either slightly left or right, depending on the perceived cross-wind, and takes the shot. Range is corrected automatically via the microprocessor shifting the display image up or down appropriately for the bullet drop. The crosshairs remain centered and the range correction is automatically provided. Cross-windage correction is also automatically made by the shooter tilting the apparatus at an angle less than 10 degrees corresponding to an estimate of the cross wind, and aiming directly at the target in the crosshairs. This tilt causes the display image to shift right or left such that correct aim remains with the crosshairs centered. The cross-windage correction is shown by the indicator 203 in the image display shown in FIG. 2.

Thus, there is shown and described a unique design and concept of a digital aiming device. While this description is directed to particular embodiments, it is understood that those skilled in the art may conceive modifications and/or variations to the specific embodiments shown and described herein. Any such modifications or variations are intended to be included herein as well. It is understood that the description herein is intended to be illustrative only and is not intended to be limitative. Rather, the scope of the invention described herein is limited only by the claims appended hereto.

What is claimed is:

1. A digital targeting scope apparatus comprising:

a tubular housing having a central axis and a first end and a second end;

an interchangeable digital camera module carried by the first end of the housing, the camera module including at least one focusing lens axially spaced from an image sensor mounted normal to a lens axis on a sensor circuit board within the camera module, wherein an image projected by the lens focuses at a predetermined location on the sensor; and a control/display module having a longitudinal axis removably fastened to the second end of the housing, wherein the control/display module is electrically connected to the camera module through a connector on the sensor circuit board of the camera module when the control/display module is installed in the second end of the housing, wherein the control/display module has a control portion including a circuit board and a display component mounted thereon and a display portion housing an eyepiece lens assembly aligned with the display component.

2. The assembly according to claim 1 wherein the control portion of the control/display module has a power source, a tilt sensor, an external computer connector, an image processor, a memory and a pair of switches all connected to a printed circuit on a printed circuit board oriented axially in the control/display module.

3. The assembly according to claim 2 wherein the camera module and control/display module are coaxially aligned in the tubular housing.

4. The assembly according to claim 2 wherein the control/display module is configured to permit a user to select between settable preprogrammed parameters when the control/display module is separated from the camera module and rotated about its longitudinal axis.

5. The assembly according to claim 4 wherein selection of one or more of the preprogrammed parameters is made by actuation of one or more of the pair of switches.

6. The assembly according to claim 1 further comprising a tilt sensor in the control/display module configured to measure a tilt angle of the device about the housing axis and cause the image processor to produce an adjusted target image in response to the measured tilt angle.

7. The assembly according to claim 6 wherein the image processor is configured to generate a change in display image field of view upon receipt from the tilt sensor of a measured tilt angle greater than a threshold angle.

8. The assembly according to claim 7 wherein a tilt angle greater than zero and less than the threshold angle causes a windage adjustment indicator in the display image field of view to change position.

9. The assembly according to claim 8 wherein the control portion of the control/display module has a power source, a tilt sensor, an external computer connector, an image processor, a memory and a pair of switches all connected to a printed circuit on a printed circuit board oriented axially in the control/display module.

10. The assembly according to claim 9 wherein the camera module and control/display module are coaxially aligned in the tubular housing.

11. The assembly according to claim 9 wherein the control/display module is configured to permit a user to select between settable preprogrammed parameters when the control/display module is separated from the camera module and horizontally held and rotated about its longitudinal axis.

12. The assembly according to claim 11 wherein selection of one or more of the preprogrammed parameters is made by actuation of one or more of the pair of switches.

* * * * *